US009701506B2

(12) United States Patent
Starkl et al.

(10) Patent No.: US 9,701,506 B2
(45) Date of Patent: Jul. 11, 2017

(54) MONITORING SYSTEM AND APPARATUS COMPRISING SUCH A MONITORING SYSTEM

(75) Inventors: Johannes Starkl, Wildenranna (DE); Alexander Stukenkemper, Fürth (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 1159 days.

(21) Appl. No.: 13/322,658

(22) PCT Filed: Apr. 23, 2010

(86) PCT No.: PCT/EP2010/055471

§ 371 (c)(1),
(2), (4) Date: Nov. 28, 2011

(87) PCT Pub. No.: WO2010/136278

PCT Pub. Date: Dec. 2, 2010

(65) Prior Publication Data

US 2012/0078576 A1 Mar. 29, 2012

(30) Foreign Application Priority Data

May 28, 2009 (DE) ..... 10 2009 022 962

(51) Int. Cl.
*B65H 29/00* (2006.01)
*B65H 26/02* (2006.01)

(52) U.S. Cl.
CPC ..... *B65H 26/02* (2013.01); *B65H 2551/21* (2013.01)

(58) Field of Classification Search
CPC ..... B65H 29/00
(Continued)

(56) References Cited

U.S. PATENT DOCUMENTS 5,239,376 A 8/1993 Dittmann et al. ..... 348/88
5,590,577 A 1/1997 Ruf et al. ..... 83/371
(Continued)

FOREIGN PATENT DOCUMENTS

CN 1802613 A 7/2006 ..... D21G 9/00
DE 4216653 A1 11/1993 ..... B26D 5/34
(Continued)

OTHER PUBLICATIONS

Report of Examination, German Patent Application No. 102009022962.0-22, 4 pages. Jan. 26, 2010.
(Continued)

*Primary Examiner* — Alexander Satanovsky
*Assistant Examiner* — Felix Suarez
(74) *Attorney, Agent, or Firm* — Slayden Grubert Beard PLLC

(57) ABSTRACT

In a monitoring system (1) for an apparatus (2) for producing and/or processing a material web (4), the monitoring system has at least one processor (10) and is equipped to perform a state and process monitoring step at the apparatus by detecting and synchronously visualizing signals, which can be generated by at least one first analysis device (5) for detecting tearing of the material web (4) in the apparatus (2) and by a number of further analysis devices (6*a*, 6*b*, 6*c*, 6*d*) for detecting physical measurement and influencing variables in the region of the apparatus.

13 Claims, 1 Drawing Sheet

(58) Field of Classification Search
USPC ..... 702/19, 106, 120, 182, 189; 156/234; 162/198; 356/432
See application file for complete search history.

(56) References Cited

U.S. PATENT DOCUMENTS

| | | | | |
|---|---|---|---|---|
| 5,821,990 | A | 10/1998 | Rudt et al. | 348/88 |
| 6,259,109 | B1 * | 7/2001 | Dalmia | G01N 21/8903 250/559.07 |
| 6,299,730 | B1 * | 10/2001 | Broek et al. | 162/198 |
| 6,405,140 | B1 | 6/2002 | Chen et al. | 702/35 |
| 6,567,171 | B1 * | 5/2003 | Rushing | 356/432 |
| 6,598,529 | B2 | 7/2003 | Müller | 101/484 |
| 6,805,501 | B2 * | 10/2004 | Winberg | G03D 5/00 396/599 |
| 7,109,464 | B2 * | 9/2006 | Cartlidge et al. | 250/208.1 |
| 7,606,629 | B2 | 10/2009 | Haaks et al. | 700/122 |
| 2003/0117492 | A1 | 6/2003 | Jokela | 348/88 |
| 2007/0272883 | A1 * | 11/2007 | Hennes et al. | 250/559.45 |
| 2009/0028416 | A1 * | 1/2009 | Floeder | G01N 21/89 382/141 |
| 2009/0050261 | A1 * | 2/2009 | Suehara | B32B 37/223 156/234 |
| 2012/0078576 | A1 | 3/2012 | Starkl et al. | 702/182 |

FOREIGN PATENT DOCUMENTS

| | | | | |
|---|---|---|---|---|
| DE | 10129889 | A1 | 1/2002 | B41F 33/14 |
| DE | 10211406 | A1 | 9/2003 | B41F 33/16 |
| EP | 0837323 | A2 | 10/1997 | G01N 21/89 |
| EP | 1314669 | A2 | 11/2002 | B65H 26/00 |
| EP | 2028144 | A2 | 2/2009 | B65H 23/188 |
| JP | 0290047 | A | 3/1990 | D21F 7/06 |
| WO | 2010/136278 | A1 | 12/2010 | B65H 26/02 |

OTHER PUBLICATIONS

International PCT Search Report and Written Opinion, PCT/EP2010/055471, 13 pages.
International Preliminary Report on Patentability, PCT/EP2010/055471, 6 pages.
Japanese Office Action, Application No. 2012-512281, 6 pages, Aug. 6, 2013.

* cited by examiner

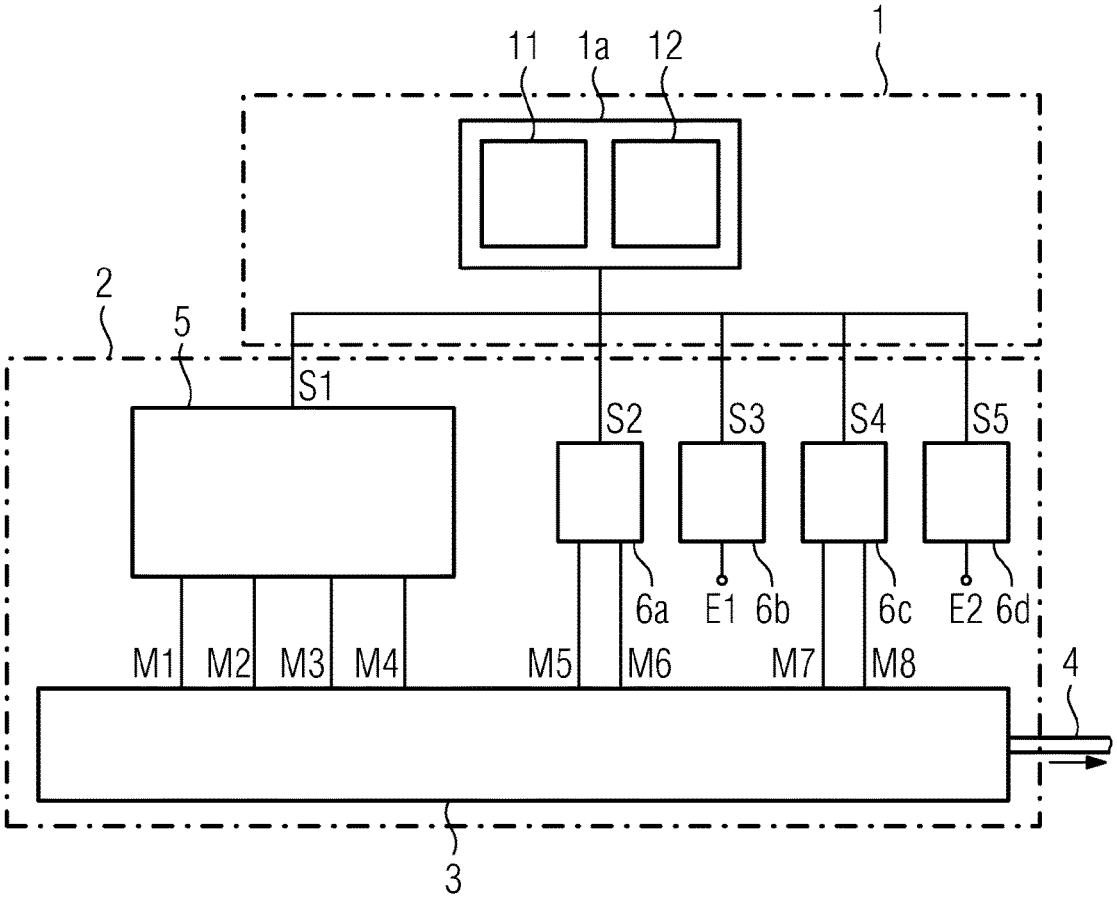
1
11
1a
12
2
5
S1
S2
S3
S4
S5
6a
E1
6b
6c
E2
6d
M1
M2
M3
M4
M5
M6
M7
M8
4
3

MONITORING SYSTEM AND APPARATUS COMPRISING SUCH A MONITORING SYSTEM

CROSS-REFERENCE TO RELATED APPLICATIONS

This application is a U.S. National Stage Application of International Application No. PCT/EP2010/055471 filed Apr. 23, 2010, which designates the United States of America, and claims priority to German Application No. 10 2009 022 962.0 filed May 28, 2009. The contents of which are hereby incorporated by reference in their entirety.

TECHNICAL FIELD

The invention relates to a monitoring system for at least one apparatus for producing and/or processing a material web, as well as to an apparatus and a method in which the monitoring system is used.

BACKGROUND

In the production and/or processing of material webs the demand for an improvement in productivity leads to higher and higher production outputs of the apparatuses used and as a consequence thereof also to higher and higher speeds of the material webs and/or higher machine speeds.

Forces acting on a material web which at low speeds do not yet constitute a problem lead at high speeds to phenomena such as flapping of the material web, for example, and as a result cause said material web to tear. Such uncontrolled and undesirable tears always result in machine downtime and consequently in a production outage. A further problem in connection with tears of said kind is that the material web runs out of control through the apparatus or a subsection of the apparatus if the occurrence of tearing is not detected quickly enough.

In order to enable the cause of a material web tear to be analyzed, first analysis devices are currently being deployed which utilize, inter alia, laser scanners, video systems, photoelectric sensors, tear detectors, etc. The documents DE 42 16 653 A1 and DE 42 16 653 A1, for example, disclose methods and first analysis devices for detecting tearing of a material web.

Reliable detection of tears is not the only requirement, however. Regular quality controls and continuous acquisition of other measurement and influencing variables which affect the production and/or processing of a material web are also necessary. Various other analysis devices are provided for that purpose.

To be cited as typical examples of apparatuses for the production and/or processing of material webs, e.g. consisting of paper, cardboard, plastic film, metal foil, textiles or composites comprising two or more of said materials, are, inter alia, paper machines, presses, calenders, rotary punching machines, rotary cutting machines, and the like.

There are thus available to the operator of an apparatus for producing and/or processing a material web signals supplied by the various first and further analysis devices for performing state and process monitoring in the region of the apparatus.

Correlating different signals with one another, in particular more than two signals, is proving to be difficult at the present time. Measurement and influencing variables that are attributable to the operator of the apparatus, environmental factors and so forth are likewise difficult to correlate with one another and with signals in relation to tear detection.

SUMMARY

According to various embodiments, an improved possibility for monitoring at least one apparatus for producing and/or processing a material web can be provided.

According to an embodiment, a monitoring system for at least one apparatus for producing and/or processing a material web, characterized may comprise at least one computing unit and is configured for performing state and process monitoring at the at least one apparatus by capturing and time-synchronously visualizing signals which can be generated by means of at least one first analysis device for detecting a tearing of the material web in the at least one apparatus and by means of a number of further analysis devices for capturing physical measurement and influencing variables in the region of the at least one apparatus.

According to a further embodiment, the at least one computing unit may comprise at least one computer program by means of which the signals can be captured and synchronized on a time bar. According to a further embodiment, the monitoring system may comprise at least one display unit for time-synchronously visualizing the signals. According to a further embodiment, the at least one computing unit may be configured for capturing signals which can be generated by at least one laser scanner and/or at least one camera and/or at least one video camera and/or at least one photoelectric sensor and/or at least one light intensity sensor. According to a further embodiment, the at least one computing unit can be configured for capturing signals which can be generated by at least one speed sensor and/or at least one ammeter and/or at least one voltmeter and/or at least one temperature sensor and/or at least one humidity measuring device and/or at least one acoustic alarm unit and/or at least one optical alarm unit.

According to another embodiment, an apparatus for producing and/or processing a material web, comprising at least one first analysis device for detecting a tearing of the material web and a number of further analysis devices for capturing physical measurement and influencing variables, characterized in that the apparatus is connected to a monitoring system as described above.

According to a further embodiment of the apparatus, the apparatus can be a paper machine, a press, a calender, a rotary punching machine or a rotary cutting machine.

According to yet another embodiment, a method for monitoring at least one apparatus for producing and/or processing a material web, may use a monitoring system as described above, wherein state and process monitoring is performed at the at least one apparatus by means of the monitoring system, which includes at least one computing unit, by capturing and time-synchronously visualizing signals which are generated by means of at least one first analysis device for detecting a tearing of the material web and by means of a number of further analysis devices for capturing physical measurement and influencing variables.

According to a further embodiment of the method, at least two apparatuses for producing and/or processing a material web or one material web each can be monitored by means of the monitoring system.

BRIEF DESCRIPTION OF THE DRAWINGS

FIG. 1 schematically shows a possible example of a monitoring system and an apparatus and a method.

DETAILED DESCRIPTION

According to various embodiments, a monitoring system for at least one apparatus for producing and/or processing a material web may comprise at least one computing unit and may be configured for performing state and process monitoring at the at least one apparatus by capturing and time-synchronously visualizing signals which can be generated by means of at least one first analysis device for detecting a tearing of the material web in the at least one apparatus and by means of a number of further analysis devices for capturing physical measurement and influencing variables in the region of the at least one apparatus.

According to other embodiments, an apparatus for producing and/or processing a material web, may comprise at least one first analysis device for detecting a tearing of the material web and a number of further analysis devices for capturing physical measurement and influencing variables, wherein the apparatus is connected to the monitoring system according to various embodiments.

Furthermore, according to other various embodiments, a method for monitoring at least one apparatus for producing and/or processing a material web may use the monitoring system as described above, wherein state and process monitoring is performed at the at least one apparatus by means of the monitoring system, which includes at least one computing unit, by capturing and time-synchronously visualizing signals which are generated by means of at least one first analysis device for detecting a tearing of the material web and by means of a number of further analysis devices for capturing physical measurement and influencing variables.

What is to be understood by "time-synchronous visualization" in the present context is a representation of all signals that can be optically registered by the operator of an apparatus over a common time axis, on the basis of which a temporal correlation of the individual detected signals is possible effectively at a glance.

The various embodiments have the advantage that the operator of an apparatus is now no longer obliged to monitor and if necessary evaluate different indicators or displays on different analysis devices, most of which are disposed spatially separated from one another, and manually correlate them with one another. The monitoring system allows a simultaneous visualization of signals which previously could not be correlated with one another without difficulty. This enables particularly fast and effective troubleshooting and fault analysis on the at least one apparatus. Faults in the region of the at least one apparatus can potentially be anticipated already before they occur, thereby enabling more timely intervention than hitherto and allowing countermeasures to be initiated. Quality assurance and documentation are considerably simplified by means of the monitoring system and production output is increased.

Furthermore a plurality of mutually independent apparatuses can be monitored by means of a single monitoring system and if necessary their detected signals examined in comparison with one another. This enables a further improvement in the acquisition of critical measurement and influencing variables as well as in the detection of interactions which do not become apparent as a matter of course when an individual apparatus is under consideration.

The at least one computing unit of the monitoring system preferably includes at least one computer program by means of which the signals of the first and further analysis devices can be captured and synchronized on a time bar. Particularly preferably the signals can be logged and stored by means of the at least one computer program time-synchronously over a relatively long time period. In this way comparisons with logs recorded by other apparatuses on the same computing unit or another computing unit of the monitoring system can also be carried out without difficulty.

It is not necessary in this case to capture all of the signals that are generated by the existing first and/or further analysis devices of the at least one apparatus in the monitoring system. However, at least the signals that are already known to the operator as relevant should be captured. It has nevertheless proven useful to capture all of the signals present in the region of the at least one apparatus in order to enable not only the already known but also previously unknown interactions and influences between measurement and influencing variables to be identified.

The monitoring system preferably includes at least one display unit, such as for example a screen, monitor or the like, to allow time-synchronous visualization of the signals captured and synchronized by the at least one computing unit. Said visualizing means can be a display unit arranged directly at the at least one apparatus and/or a display unit arranged at some distance from the at least one apparatus, for example a display unit in a control center for allowing remote control of an apparatus. In this case the at least one display unit is connected to the at least one computing unit by way of a cable or wirelessly or alternatively it is a component of the at least one computing unit.

The at least one computing unit is configured in particular for capturing signals which can be generated by at least one laser scanner and/or at least one camera and/or at least one video camera and/or at least one photoelectric sensor and/or at least one light intensity sensor or the like. These are preferably deployed in the region of a first analysis device for detecting a tearing of the material web.

The at least one computing unit is furthermore preferably configured for capturing signals which can be generated by at least one speed sensor and/or at least one ammeter and/or at least one voltmeter and/or at least one temperature sensor and/or at least one humidity measuring device and/or at least one acoustic alarm unit and/or at least one optical alarm unit or the like.

Further signals reflecting a movement of the material web, a defect in the material web, such as e.g. in the form of holes, tears, folds, turned-up edges, etc., a malfunction of the apparatus, an intervention by an operator and so forth, can be captured by means of the at least one computing unit, synchronized and time-synchronously visualized by way of the at least one display unit.

Also preferably, at least two apparatuses for producing and/or processing one material web or one material web each can be monitored by means of the monitoring system. In this case the monitored apparatuses can be operated independently of each other or in parallel, for example two paper machines, each of which produces a material web. However, the monitored apparatuses can also be operated in succession. This would be the case for example with a paper machine and an immediately succeeding rotary punching machine, the rotary punching machine punching openings into the material web produced in the paper machine.

Shown schematically in the lower half of the diagram in FIG. 1 is an apparatus 2 for producing a material web 4. The apparatus 2 comprises a paper machine 3 in which the material web 4, in this case in the form of a paper web, is formed and conveyed in the direction of the arrow. The apparatus 2 further comprises a first analysis device 5 for detecting a tearing of the material web 4, which analysis device 5 collects the measurement variables M1, M2, M3, M4 in the region of the paper machine 3 by means of photoelectric sensors and speed sensors, links them together and, in the event of a tearing of the material web 4 being detected, outputs a warning signal. In this case the first analysis device 5 can also intervene in the open- and/or closed-loop control of the paper machine 3 in order to prevent an imminent tearing and/or, after tearing has taken place, to initiate safeguarding measures such as for example stopping the paper machine 3 and the like. The apparatus 2 comprises further analysis devices 6*a*, 6*b*, 6*c*, 6*d* for capturing physical measurement and influencing variables in the region of the apparatus 2. Thus, a first of the further analysis devices 6*a* is a multimeter which captures a measurement variable M5 in the form of a consumption of electric current and a measurement variable M6 in the form of a voltage of a drive motor in the region of the paper machine 3. A second of the further analysis devices 6*b* is a temperature measuring device which measures the ambient temperature as an influencing variable E1 acting on the paper machine 3.

A third of the further analysis devices 6*c* is a video camera which as measurement variables M7 and M8 provides images of the material web 4 during its pass through the paper machine 3. Formation of folds, holes, turned-up edges, tears or other defects in the material web 4 can be detected by means of the video camera. A fourth of the further analysis devices 6*d* is a humidity measuring device which measures the absolute air humidity in the vicinity of the paper machine 3 as an influencing variable E2 acting on the paper machine 3. Additional further analysis devices which register malfunctions of the paper machine 3, the progression of the material web 4 in the paper machine 3, operator instructions, interventions by the operator, other external influencing factors, such as e.g. due to vibration or incident solar radiation, and the like can, of course, also be present.

Also shown schematically in the top half of the diagram in FIG. 1 is a monitoring system 1 for the apparatus 2, which monitoring system 1 includes a computing unit 1*a*. The computing unit 1*a* is configured for performing state and process monitoring on the apparatus 2 by capturing and time-synchronously visualizing signals S1, S2, S3, S4, S5 which are generated by means of the first analysis device 5 for detecting a tearing of the material web and by means of the further analysis devices 6*a*, 6*b*, 6*c*, 6*d* for capturing physical measurement variables M1, M2, M3, M4, M5, M6, M7, M8 and influencing variables E1, E2 in the region of the apparatus 2.

The computing unit 1*a* includes a computer program 11 by means of which the signals S1, S2, S3, S4, S5 are captured and synchronized on a time bar. The monitoring system 1 additionally includes a display unit 12 which in the present example is integrated into the computing unit 1*a*, though it could also be connected to the computing unit 1*a* simply by way of a cable or wirelessly.

The display device 12 serves to provide the operator of the apparatus 2 with a detailed visual overview of all generated signals S1, S2, S3, S4, S5 in a single display and on a common time bar.

This makes it easier for the operator of the apparatus 2 to recognize relationships between individual signals S1, S2, S3, S4, S5. Troubleshooting and fault analysis is made easier and faster. This enables the operator to respond quickly and avert imminent damage to the apparatus 2 in good time. Furthermore, quality assurance and documentation are considerably simplified and improved and production output is increased.

A person of average skill in the art having knowledge of the invention is able without difficulty to apply the solution according to the invention to a variety of apparatuses for producing and/or processing a material web. These could be, for example, presses, calenders, rotary punching machines, rotary cutting machines, and the like. Moreover, material webs can be formed not only from paper, but also, for example, from cardboard, plastic film, metal foil, textiles or composites comprising two or more of these materials, including paper. The first and further analysis devices of an apparatus that are chosen can furthermore be different in terms of type and number. What is important here is simply that at least the relevant, though preferably all, measurement and influencing variables can be captured in the monitoring system and time-synchronously visualized. Furthermore, a monitoring system can monitor not just one apparatus, but also two or more apparatuses simultaneously. In this case the apparatuses can be disposed separated from one another, parallel to one another, and/or one behind another in a sequential arrangement.

What is claimed is:

1. A monitoring system for at least one apparatus for producing and/or processing a material web, the monitoring system comprising:

a first analysis device for detecting a tearing of the material web in the at least one apparatus, the first analysis device including at least one photoelectric sensor and at least one speed sensor, and a plurality of second analysis devices for capturing detectable parameters of the at least one apparatus, the plurality of second analysis devices including:

an electronic sensor configured to measure at least one of a consumption current or a voltage of a drive motor, and a temperature sensor configured to measure an ambient temperature, at least one computing unit configured for performing state and process monitoring at the at least one apparatus by:

capturing and analysing first signals from the at least one photoelectric sensor and at least one speed sensor of the first analysis device to detect a tearing of the material web in the at least one apparatus, and capturing further signals generated by each of the plurality of second analysis devices for capturing detectable parameters of the at least one apparatus, automatically synchronizing the first signals generated by the at least one first analysis device and the further signals generated by each of the plurality of second analysis devices, with respect to a common time bar, and a display unit for displaying a time-synchronous visualization of the synchronizing first signals and further signals on the common time bar.

2. The monitoring system according to claim 1, wherein the at least one computing unit includes at least one computer program by means of which the signals can be captured and synchronized on a time bar.

3. The monitoring system according to claim 1, wherein the at least one computing unit is configured for capturing signals which can be generated by at least one of: at least one laser scanner, at least one camera, at least one video camera, at least one photoelectric sensor, and at least one light intensity sensor.

4. The monitoring system of claim 1, wherein the plurality of second analysis devices include, in addition to the electronic sensor and the temperature sensor, at least one of a speed sensor, a humidity measuring device, an acoustic alarm unit, or an optical alarm unit.

5. An apparatus for producing and/or processing a material web, the apparatus comprising:

at least one first analysis device for detecting a tearing of the material web, the first analysis device including at least one photoelectric sensor and at least one speed sensor, a plurality of second analysis devices for capturing detectable parameters of the at least one apparatus, the plurality of second analysis devices including:

an electronic sensor configured to measure at least one of a consumption current or a voltage of a drive motor, and a temperature sensor configured to measure an ambient temperature, wherein the monitoring system includes at least one computing unit configured for performing state and process monitoring at the at least one apparatus by:

capturing and analysing first signals from the at least one photoelectric sensor and at least one speed sensor of the first analysis device for detecting the tearing of the material web in the at least one apparatus, capturing further signals generated by each of the plurality of second analysis devices for capturing detectable parameters, and automatically synchronizing the first signals generated by the at least one first analysis device and the further signals generated by each of the plurality of second analysis devices, with respect to a common time bar, and a display unit for displaying a time-synchronous visualization of the synchronized first signals and further signals on the common time bar.

6. The apparatus according to claim 5, wherein the apparatus is a paper machine, a press, a calendar, a rotary punching machine or a rotary cutting machine.

7. The apparatus according to claim 5, wherein the at least one computing unit includes at least one computer program by means of which the signals can be captured and synchronized on the time bar.

8. The apparatus according to claim 5, wherein the at least one computing unit is configured for capturing signals which can be generated by at least one of: at least one laser scanner, at least one camera, at least one video camera, at least one photoelectric sensor, and at least one light intensity sensor.

9. A method for monitoring at least one apparatus for producing and/or processing a material web, the method using a monitoring system, the method comprising:

performing, by a computing unit of the monitoring system, state and process monitoring at the at least one apparatus by:

capturing first signals generated by at least one first analysis device for detecting a tearing of the material web in the at least one apparatus, the first analysis device including at least one photoelectric sensor and at least one speed sensor, capturing further signals generated by each of a plurality of second analysis devices for capturing detectable parameters of the at least one apparatus, the plurality of second analysis devices including an electronic sensor configured to measure at least one of a consumption current or a voltage of a drive motor, and a temperature sensor configured to measure an ambient temperature, and automatically generating and displaying a time-synchronous visualization of the first signals generated by the at least one first analysis device and the further signals generated by each of the plurality of second analysis devices, on a common time bar.

10. The method according to claim 9, wherein at least two apparatuses for producing and/or processing a material web or one material web each are monitored by means of the monitoring system.

11. The method according to claim 9, wherein the at least one computing unit includes at least one computer program by means of which the signals can be captured and synchronized on the time bar.

12. The method according to claim 9, wherein the monitoring system includes at least one display unit for time-synchronously visualizing the signals.

13. The method according to claim 9, wherein the at least one computing unit is configured for capturing signals which can be generated by at least one of: at least one laser scanner, at least one camera, at least one video camera, at least one photoelectric sensor, and at least one light intensity sensor.

* * * * *